US007964330B2

(12) United States Patent
Shinmura et al.

(10) Patent No.: US 7,964,330 B2
(45) Date of Patent: Jun. 21, 2011

(54) ELECTROPHOTOGRAPHIC RESIN-COATED FERRITE CARRIER, METHOD FOR PRODUCING THE SAME, AND ELECTROPHOTOGRAPHIC DEVELOPER

(75) Inventors: Issei Shinmura, Kashiwa (JP); Kanao Kayamoto, Kashiwa (JP)

(73) Assignee: Powertech Co., Ltd., Kashiwa-shi, Chiba (JP)

( * ) Notice: Subject to any disclaimer, the term of this patent is extended or adjusted under 35 U.S.C. 154(b) by 1115 days.

(21) Appl. No.: 11/729,938

(22) Filed: Mar. 30, 2007

(65) Prior Publication Data

US 2007/0231732 A1 Oct. 4, 2007

(30) Foreign Application Priority Data

Mar. 30, 2006 (JP) ..... 2006-093675

(51) Int. Cl.
*G03G 9/00* (2006.01)

(52) U.S. Cl. ..... 430/111.35; 430/111.41; 430/111.31

(58) Field of Classification Search ..... 430/111.35, 430/111.41, 111.31
See application file for complete search history.

(56) References Cited

U.S. PATENT DOCUMENTS

| | | | | |
|---|---|---|---|---|
| 5,419,994 | A * | 5/1995 | Honjo et al. | 430/111.35 |
| 6,365,316 | B1 * | 4/2002 | Stamp et al. | 430/111.41 |
| 2003/0044711 | A1 * | 3/2003 | Hutcheson | 430/111.31 |
| 2006/0194137 | A1 * | 8/2006 | Kobayashi et al. | 430/111.31 |

* cited by examiner

*Primary Examiner* — Mark A Chapman
(74) *Attorney, Agent, or Firm* — Rothwell, Figg, Ernst & Manbeck P.C.

(57) ABSTRACT

There are adopted an electrophotographic resin-coated ferrite carrier having a carrier core coated with a resin, wherein a product of an apparent density ρ (g/cm$^3$), average particle size d (μm) and BET specific surface area S (m$^2$/g) of the carrier core satisfies the following condition, a method for producing the same, and an electrophotographic developer.

$4.5 \leqq \rho \times d \times S \leqq 8.5 \ (20 \leqq d \leqq 45)$

8 Claims, 1 Drawing Sheet

ELECTROPHOTOGRAPHIC RESIN-COATED FERRITE CARRIER, METHOD FOR PRODUCING THE SAME, AND ELECTROPHOTOGRAPHIC DEVELOPER

BACKGROUND OF THE INVENTION

1. Field of the Invention

The present invention relates to an electrophotographic resin-coated ferrite carrier having a small particle size, a spherical shape and a sharp particle size distribution, and yet providing low beads carry over and low variation with time of charge quantities and resistance in continuous printing when being used for a developer, a method for producing the same, and an electrophotographic developer using the resin-coated ferrite carrier.

2. Description of the Related Art

A two-component developer used in electrophotography is constituted of a toner and a carrier; the carrier is mixed and agitated with the toner in a developer box; the toner is given a desired charge; and the charged toner is carried to an electrostatic latent image on a photoreceptor whereby the developer is a carrier material to form a toner image. The carrier is, after having formed the toner image, held by a magnet and stays on a development roll, further returned to the developer box, again mixed and agitated with new toner particles, and repeatedly used in a certain period.

The two-component developer, different from a one-component developer, is one in which the carrier agitates the toner particles, imparts a desired charge, and has a function of transporting the toner, has good controllability in developer design, and is therefore widely used in the fields of full-color machines requiring high-quality images and high-speed machines requiring reliability and durability with respect to image sustainment.

In such a two-component electrophotographic developer, ferrite particles made of Cu—Zn ferrite, Ni—Zn ferrite or the like have been used as a carrier in place of an oxide-coated iron powder or a resin-coated iron powder in order to obtain high-quality images. Ferrite carriers formed of these ferrite particles commonly have many characteristics to form high-quality images, such as a high sphericity and adjustable magnetic properties, more advantageous than the conventional iron powder carrier. Furthermore, a resin-coated ferrite carrier coated with various resins using the ferrite particles as the carrier core has enhanced abrasion resistance and durability or the like. Also, the resin-coated ferrite carrier has adjustable specific volume resistance.

However, since the ferrite is ceramic, the ferrite after the ferritization reaction has high hardness. Adversely, the ferrite has the disadvantage that it is crushed by impact. When the particle size is particularly reduced, a space between the particles is also reduced, and the fusion of the particles is generated by high-temperature heating to complicate the sustainability of the spherical shape.

In recent years, in such a two-component electrophotographic developer, the high-speed and full-color of development performance have been strongly required, and under the requirements, the reduction in the particle size of the carrier or toner has been a subject in order to obtain high-quality images output.

Referring to the toner, there have been proposed various toners having a small particle size and a sharp particle size distribution by a polymerized toner technique or the like.

On the other hand, a formed magnetic brush is softened by reducing the particle size of the carrier, that is, by using the ferrite particles having a small particle size. Also, the specific surface area of the carrier is increased, and the quantity of the toner capable of being held is increased. As a result, larger effects have been expected for image quality such as image density, fog, toner scattering and gradation.

However, when the particle size of the ferrite carrier is reduced, unfortunately, it becomes difficult to sustain the spherical shape of the above-described ferrite particles. As described above, various resins are coated on the surface of the carrier core (ferrite particles) in order to enhance the abrasion resistance and the durability. However, when the shape of each of the ferrite particles is impaired, coating unevenness is generated in resin coating, or the exposed part of the core material is generated. Therefore, the carrier performance is not sufficient to attain a higher image quality and a longer life (higher durability) required of the developer.

Also, when the particles are ground in the grinding step after baking in the producing step of the ferrite particles, and the fused particles are ground by strong impact, the particles are crushed, and irregular particles are mixed. It is difficult to remove the irregular particles, which cause beads carry over. If the resin is coated as it is in the next step, a uniform film cannot be formed on each of the irregular particles, and the irregular particles hinder flowability, causing adverse effects to the image quality.

Although the fusion between the particles can be prevented by reducing a baking temperature in order to sustain the spherical shape, the carrier core becomes porous (porosity), and the resin is oozed into the inside in the resin coating step to the surface of the carrier core, and the resin is apt to become the variation factor of the carrier performance.

Thus, techniques for producing the ferrite particles having a spherical shape, a uniform surface nature and a small particle size have been insufficient. There have been made various efforts for providing the ferrite carrier having a spherical shape, a uniform surface nature and a small particle size in order to attain a higher image quality and a longer life when used as a two-component developer together with a toner.

Japanese Patent Laid-Open No. 7-98521 discloses an electrophotographic carrier having a particle size distribution specified by a 50% average particle size ($D_{50}$) of 15 to 45 μm and a fixed ratio of specific surface areas determined by different measuring methods.

Also, Japanese Patent Laid-Open No. 2001-117285 discloses a carrier for electrostatic image development comprising core particles (carrier core) which have a volume average particle size of 25 to 50 μm and certain ranges of volume resistance and shape factor, and a coating layer formed on the surface of each of the core particles and containing conductive particles.

Japanese Patent Laid-Open No. 8-292607 discloses a two-component developer comprising carrier core particles having a coating layer formed on the surface thereof and made of a resin material, and specified shape factor of the carrier core particles and carrier particles after resin coating, the former shape factor being larger than the latter shape factor.

Japanese Patent Laid-Open No. 9-197722 discloses a carrier for electrostatic image developer which has saturation magnetization of 50 to 70 $Am^2/kg$, an average particle size of 30 to 40 μm, a weight ratio of particles having an average particle size of 22 μm or less being 2.0 to 17.0% by weight, and a coating layer formed on core particles (carrier core) specified by a shape factor.

Although the above-described Patent Documents reduce the particle size of the ferrite core material, specify the shape factor and the specific surface area or the like, and mainly obtain the spherical ferrite core material, a carrier core or a resin-coated ferrite carrier having a small particle size, a high spherical degree, a high surface evenness and a sharp particle size distribution, and a method for producing the same have not been obtained.

Also, when a resin-coated ferrite carrier is used as a developer together with a toner, the developer is required to have small variations with time in charge quantity and resistance in continuous printing. However, a carrier core or resin-coated ferrite carrier for satisfying both of these requirements, and a method for producing the same have not been obtained.

SUMMARY OF THE INVENTION

Therefore, it is an object of the present invention to provide an electrophotographic resin-coated ferrite carrier having a small particle size, a spherical shape and a sharp particle size distribution, and yet providing low beads carry over and low variation with time of charge quantities and resistance in continuous printing when being used for the developer, a method for manufacturing the same, and an electrophotographic developer using the resin-coated ferrite carrier.

Then, as a result of keen examinations for solving these problems, the present inventors found that a resin-coated ferrite carrier of which a product of an apparent density, average particle size and BET specific surface area of a carrier core is in a fixed range can attain the above object. Also, the present inventors found that such a resin-coated ferrite carrier can be produced by limiting the slurry particle sizes, $D_{50}$ and $D_{90}$, to be a fixed range or less. The present invention was accomplished based on this finding.

That is, the present invention provides an electrophotographic resin-coated ferrite carrier having a carrier core coated with a resin, wherein a product of an apparent density ρ (g/cm$^3$), average particle size d (μm) and BET specific surface area S (m$^2$/g) of the carrier core satisfies the following condition.

$$4.5 \leqq \rho \times d \times S \leqq 8.5 \quad (20 \leqq d \leqq 45)$$

Desirably, in the electrophotographic resin-coated ferrite carrier according to the present invention, at 1 KOe, a bulk magnetization A of the carrier core is 50 to 70 Am$^2$/kg; a difference (A−B) between the main magnetization A and a scattering magnetization B thereof is 10 Am$^2$/kg or less; and a percent inclusion of a carrier core having a magnetization at least 10 Am$^2$/kg lower than the bulk magnetization A is 50 ppm or less.

Desirably, the carrier core has a shape factor SF-1 of 100 to 120 in the electrophotographic resin-coated ferrite carrier according to the present invention.

Desirably, the carrier core has a particle size distribution CV value of 23 or less in the electrophotographic resin-coated ferrite carrier according to the present invention.

Desirably, the carrier core has a resistance of $10^5$ to $10^9\Omega$ at 1000 V in the electrophotographic resin-coated ferrite carrier according to the present invention.

Desirably, the carrier core is coated with 0.1 to 10% by weight of the resin in the electrophotographic resin-coated ferrite carrier according to the present invention.

Also, the present invention provides a method for producing an electrophotographic resin-coated ferrite carrier, comprising the steps of: grinding, mixing and pelletizing ferrite raw materials; pre-baking the pellets at 900 to 1200° C.; grinding the preliminarily baked pellets; producing a slurry from the resulting particles; granulating the obtained slurry; baking the granules at 1100 to 1450° C. for 1 to 24 hours under an oxygen concentration of 0 to 21 vol. % to obtain a carrier core having an average particle size of 20 to 45 μm; and coating the obtained carrier core with a resin, wherein slurry particle sizes, $D_{50}$ and $D_{90}$, of the slurry are 3.0 μm or less and 4.0 μm or less, respectively.

Desirably, the slurry particle sizes, $D_{50}$ and $D_{90}$, of the slurry are 2.0 μm or less and 3.0 μm or less, respectively, in the method for producing the electrophotographic resin-coated ferrite carrier according to the present invention.

Desirably, a difference in temperature between the firing and the preliminary firing is 280° C. or less in the method for producing the electrophotographic resin-coated ferrite carrier according to the present invention.

The present invention provides an electrophotographic developer comprising the resin-coated ferrite carrier and a toner.

Since the product of the specific surface area, apparent density and average particle size of the carrier core is in a prescribed range in the electrophotographic resin-coated ferrite carrier according to the present invention, the electrophotographic resin-coated ferrite carrier has a small particle size, is spherical, has a sharp particle size distribution, and yet provides low carrier scattering. The electrophotographic developer using the electrophotographic resin-coated ferrite carrier according to the present invention provides low variation with time of charge quantities and resistance in continuous printing.

According to the producing method according to the present invention, the above-described ferrite carrier for the electrophotographic developer can be economically produced at industrial-scale productivity.

DETAILED DESCRIPTION OF THE PREFERRED EMBODIMENTS

Figure 1:
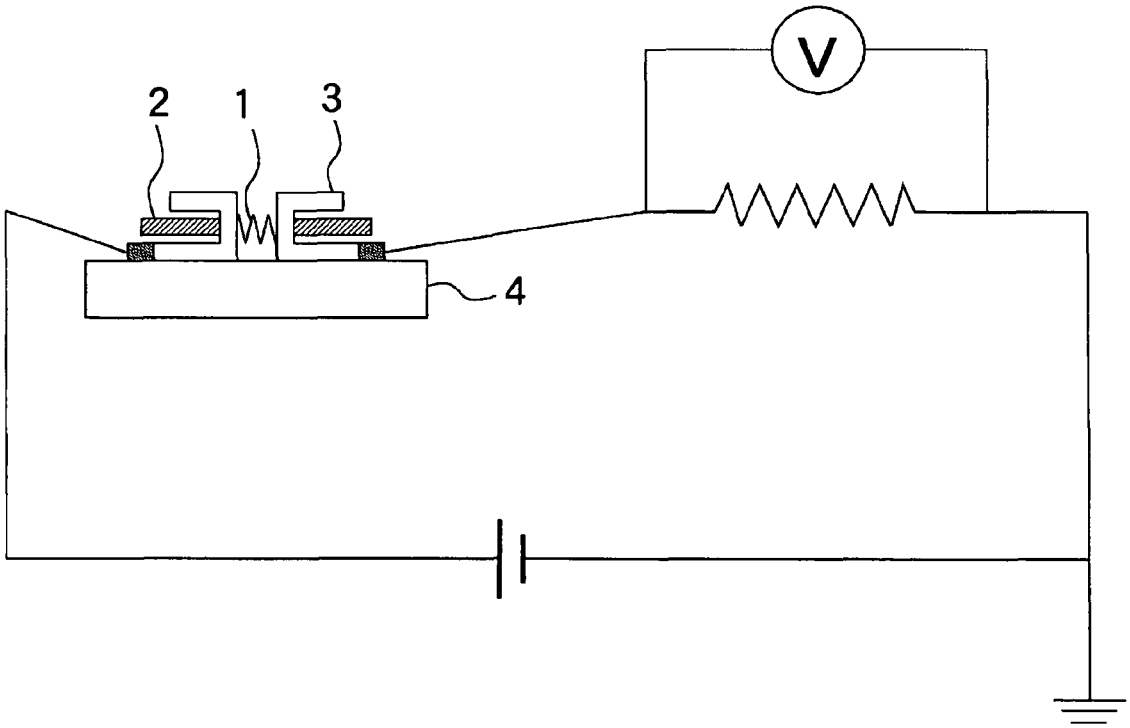
FIG. 1 schematically illustrates an electric resistance measuring apparatus used for measuring the electric resistance of a carrier core (ferrite particles).

Hereinafter, the embodiments of the present invention will be described.

<Electrophotographic Resin-Coated Ferrite Carrier According to Present Invention>

An electrophotographic resin-coated ferrite carrier according to the present invention requires that the product of an apparent density ρ (g/cm$^3$), average particle size d (μm) and BET specific surface area S (m$^2$/g) of carrier core particles should satisfy the following condition. The resin-coated ferrite carrier having a small particle size, a spherical shape and a sharp particle size distribution, and yet providing low carrier scattering is obtained by satisfying such a requirement.

$$4.5 \leqq \rho \times d \times S \leqq 8.5 \quad (20 \leqq d \leqq 45)$$

In the above formula, when the product of the apparent density ρ(g/cm$^3$), average particle sized (μm) and BET specific surface area S (m$^2$/g) is less than 4.5, it is substantially difficult to industrially produce the carrier core (ferrite particles). When the product thereof exceeds 8.5, the spherical degree and the sharpness of particle size distribution are reduced, and the carrier scattering is increased. Also, the variation with time of charge quantities and resistance in continuous printing when being used for the developer is increased.

In the electrophotographic resin-coated ferrite carrier according to the present invention, the carrier core has an average particle size d of 20 to 45 μm as described above. A carrier core (ferrite particles) having an average particle size of less than 20 μm cannot be industrially produced in practice.

An average particle size above 45 μm is opposed to the original purpose of particle size reduction, and disadvantageous to obtain high-quality images.

Here, the apparent density, the average particle size and the BET specific surface area are measured by the following method.

[Apparent Density]

The apparent density is measured based on JIS Z 2504. The detail is described as follows.

1. Apparatus

There is used a powder apparent densimeter provided with a funnel, a cup, a funnel support, a support bar and a support base. A balance used here has a reciprocal sensibility of 50 mg in weighing 200 g.

2. Measuring Method (1) The amount of a sample is set to at least 150 g.

(2) The sample is in pouring until the sample poured into the funnel having an orifice having a pore size of $2.5^{+0.2/-0}$ mm and flowed off fills the cup and overflows.

(3) When the sample begins to overflow, the inflow of the sample is immediately stopped, and the sample rising on the cup is flatly scraped off along the upper end of the cup by a spatula so as not to impart vibration.

(4) The side of the cup is lightly struck to sink the sample; the sample adhered to the outside of the cup is removed; and the weight of the sample in the cup is weighed in the accuracy of 0.05 g.

3. Calculation

A numerical value obtained by multiplying the measured value obtained by the preceding item 2-(4) by 0.04 is rounded to the second decimal place according to JIS-Z8401 (how to round a numerical value) and defined as an apparent density of a unit of "g/cm$^3$".

[Average Particle Size (Median Size)]

The average particle size is measured by a laser diffraction scattering method. A Microtrac particle size analyzer (Model 9320-X100) manufactured by Nikkiso Co., Ltd. is used as a device. A refractive index is set to 2.42, and the measurement is performed in an environment at 25±5° C. and 55±15% humidity. Here, the average particle size (median size) means an accumulation size particle of 50% in a volume distribution mode and an undersize expression.

A carrier sample is dispersed by a supersonic treatment in a ultrasonic homogenizer (UH-3C) manufactured by ultrasonic Industrial Company for 1 minute using a 0.2% sodium hexametaphosphate solution as a dispersion liquid.

[BET Specific Surface Area]

A specific surface area measuring instrument (type: GEMINI 2360, manufactured by Shimadzu Corporation) is used. 10 to 15 g of a measuring sample is placed in a measuring cell, and is correctly weighed by a precision balance. After the weighing is completed, a vacuum suction heat treatment is performed at 200° C. for 60 minutes by a gas port attached to the instrument. Then, the sample is set to a measuring port and the measurement is started. The measurement is performed by a ten point method, and when the weight of the sample is input in the measurement end, the BET specific surface area is automatically calculated.

Measuring Cell: spherical outer shape: 1.9 cm (¾ inch), length: 3.8 cm (1 to ½ inches), cell length: 15.5 (6.1 inches), volume 12.0 cm$^3$, sample volume: about 6.00 cm$^3$ Environment: temperature; 10 to 30° C., humidity; relative humidity of 20 to 80%, with no dew condensation In the electrophotographic resin-coated ferrite carrier according to the present invention, desirably, at 1 KOe a bulk magnetization A of the carrier core magnetic field is 50 to 70 Am$^2$/kg; a difference between the bulk magnetization A and magnetization B of debris is 10 Am$^2$/kg or less; and a percent inclusion of a carrier core having a magnetization at least 10 Am$^2$/kg lower than the bulk magnetization A is 50 ppm or less.

When the bulk magnetization A, the difference (A−B) between the bulk magnetization A and the scattering magnetization B, and the percent inclusion of the carrier core having a magnetization at least 10 Am$^2$/kg lower than the bulk magnetization A are departed from the above range, beads carry over is disadvantageously increased in the development.

This magnetization (the bulk magnetization A and the debris magnetization B) and the debris amount (the percent inclusion of the carrier core having a magnetization at least 10 Am$^2$/kg lower than the bulk magnetization A) are measured by the following method.

[Measurement of Magnetization]

There is used an oscillating sample magnetism measuring device (type: VSM-C7-10A, manufactured by TOEI INDUSTRY CO., LTD.). A test sample is placed in a cell having an inner diameter of 5 mm and a height of 2 mm, is set in the above device. The sample was sweeping by an applied magnetic field up to 1 KOe. Then, the applied magnetic field is decreased and a hysteresis curve is produced in a record paper. The magnetization is calculated by the data of this curve.

[Amount of Debris and Method for Measuring Magnetization of Debris]

The measurement is performed by a scattering test method. That is, when 600 g of the carrier core (sample) is placed in a commercially available developer box for a copier and the sample is agitated for 20 minutes at a rotation number of 200 rpm by a motor, the sample scattered from the developer box is collected, and the debris amount and the magnetization at 1 KOe of the debris are calculated by the above magnetization measuring method.

Desirably, in the electrophotographic resin-coated ferrite carrier according to the present invention, the carrier core has a shape factor SF-1 of 100 to 120. When the shape factor SF-1 exceeds 120, the spherical degree of the resin-coated ferrite carrier cannot be attained, coating unevenness takes place in resin coating, or the exposed part of the core material takes place. Thereby, the leak phenomenon of charges is apt to take place, and it is disadvantageous to obtain the high-quality images. This shape factor SF-1 is used as a factor for expressing the shape of particles or the like, and is based on the statistical method of image analysis capable of quantitatively analyzing the area, length, shape and the like of an image made by a scanning electron microscope or the like with a high accuracy. It is measured by the following method.

[Shape Factor SF-1]

The shape factor SF-1 is obtained by photographing carrier SEM using an electron microscope (type: JSM-6060A (manufactured by JEOL. Ltd.)), introducing the image information into an image analyzing device (Image-Pro PLUS) manufactured by Cybernetics via interfaces, analyzing the image information and calculating by the following formula. The closer to the sphericity the shape of the carrier is, the closer to 100 the shape factor SF-1 is. The SF-1 is calculated per one particle, and the average value of 100 particles is defined as the shape factor of the carrier.

$$SF\text{-}1=(R^2/S)\times(\pi/4)\times 100$$

R: diameter [(minimum diameter+maximum diameter)/2],

S: projected area

Desirably, the carrier core has a particle size distribution CV value of 23 or less in the electrophotographic resin-coated ferrite carrier according to the present invention. When the particle size distribution CV value exceeds 23, a sharp particle size distribution is not obtained, and an adverse effect to the image quality is generated. This particle size distribution CV value is calculated by the following method.

[Particle Size Distribution CV (Variation Coefficient of Particle size) Value]

A laser type particle size analyzer (type: Microtrac HRA MODEL: 9320-x100 (manufactured by Nikkiso Co., Ltd.)) is used, and a CV (variation coefficient of particle size) value is calculated by the following formula using the standard deviation (STD. DEV) of a volume average size (MV) and particle size.

$$CV\ \text{Value}=\text{STD. DEV}/MV\times 100$$

MV: Volume Average Size

STD. DEV: (d84%−d16%)/2 d84%; Particle Size (μm) of Points in which Accumulation Curve is 84% d16%; Particle Size (μm) of Points in which Accumulation Curve is 16%

Desirably, the carrier core has a resistance of $10^5$ to $10^9$ at 1000 V in the electrophotographic resin-coated ferrite carrier according to the present invention. When the resistance exceeds $10^9\Omega$, the image density is disadvantageously hardly come out. When the resistance is less than $10^5\Omega$, it is disadvantageous because leakage is more likely to take place and high-quality images are thus not obtained. This method of resistance measurement is as follows.

[Resistance]

The resistance is measured using an electric resistance measuring apparatus as shown in FIG. 1. Reference numerals 1, 2, 3 and 4 denote a carrier core (sample), a magnet, a brass plate (electrode) and a fluororesin plate 4, respectively. A sample (0.2 g) is weighed and inserted between nonmagnetic parallel flat-plate electrodes (area: 10×40 mm) having a distance between magnetic poles of 2.0 mm so as to make an N pole and an S pole face each other. The sample is held between the electrodes by attaching the magnetic poles (surface flux density: 1500 Gauss, facing electrode surface area: 10×30 mm) to the parallel flat-plate electrodes, and the electric resistance of an applied voltage of 1000 V is measured by an insulation electric resistance meter (type: SM-5E super mega ohm meter (manufactured by DKK-TOA Corporation)).

The resin is coated desirably in an amount of 0.1 to 10% by weight based on the carrier core in the electrophotographic resin-coated ferrite carrier according to the present invention. With the coating amount of less than 0.1% by weight, the formation of a uniform coating layer on the carrier surface becomes difficult. With that exceeding 10% by weight, the cohesion of the carriers is generated.

The resin used for coating the carrier core is not particularly limited, and various resins can be used as the coating resin. For example, fluororesins, fluoro-acrylic resins, silicone resins and modified silicone resins or the like can be used for a positive charging toner. Conversely, for example, acrylic resins, acrylic-styrene resins, mixed resins and cured resins of the acrylic-styrene resin and melamine resin, silicone resins, modified silicone resins, polyester resins, epoxy resins, urethane resins and polyethylene resins or the like can be used for a negative charging toner.

A charge control agent, an adhesion enhancer, a priming agent, a resistance control agent or the like may be optionally added. Examples of the charge control agents and resistance control agents include various silane coupling agents, various titanium coupling agents, conductive carbon, boride such as titanium boride, and oxides such as titanium oxide and iron oxide, an aluminum oxide, a chromic oxide and a silicon oxide. However, the charge control agents and the resistance control agents are not particularly limited thereto.

<Method for Producing Electrophotographic Resin-Coated Ferrite Carrier According to Present Invention>

Next, a method for producing an electrophotographic resin-coated ferrite carrier according to the present invention will be described.

First, after weighing an adequate quantity of ferrite raw materials so as to be a specified composition, it is ground and mixed in a ball mill or a vibration mill or the like for 0.5 hour or more, preferably 1 to 20 hours. After pelletizing the ground material thus obtained using a pressing machine or the like, the pellets are preliminarily baked at a temperature of 900 to 1200° C. When the preliminary baking temperature is less than 900° C., the shape of the carrier surface after final firing is disadvantageously formed in a protrusion and recess shape. When the preliminary baking temperature exceeds 1200° C., the carrier is hardly ground. Instead of using the pressing machine, the ferrite raw material can be granulated after grinding, producing slurry by adding water, and spray-drying the slurry.

After the preliminary baking, the ferrite raw material is further ground using a ball mill or a vibrating mill or the like, water and, as required, an adequate quantity of a dispersant and a binder and the like are added to produce a slurry. After adjusting viscosity, the slurry is then granulated using a spray dryer, and the resulting granules are finally baked at a controlled oxygen concentration of 0 to 21 vol. % and at a temperature of 1,100 to 1,450° C. for 1 to 24 h. In the grinding after the preliminary firing, the raw material may be ground using a wet ball mill or a wet vibration mill after water is added.

In the producing method according to the present invention, the slurry particle size of the obtained slurry must be adjusted within the following ranges. That is, $D_{50}$ of the slurry particle size (volume average size) is 3.0 μm or less, preferably 2.0 μm or less, and $D_{90}$ is 4.0 μm or less, and preferably 3.0 μm or less. When the above-described $D_{50}$ exceeds 3.0 μm, and the $D_{90}$ exceeds 4.0 μm, the shape of the carrier surface after the final firing is disadvantageously formed in a protrusion and recess shape. The slurry particle size is measured using a Microtrac Particle Size Analyzer (Model 9320-X100) manufactured by Nikkiso Co., Ltd. The detail is as follows.

[Slurry Particle Size ($D_{50}$, $D_{90}$)]

Here, $D_{50}$ means an accumulation size particle of 50% in a volume distribution mode and an undersize expression, and $D_{90}$ means an accumulation size particle of 90% in a volume distribution mode and an undersize expression. The environment, refractive index and dispersion method in measuring the slurry particle size is based on the dispersion method in measuring the above carrier average particle size.

Thus, since the uniformity of materials can be promoted and the variation in the magnetization between the particles can be reduced by miniaturizing the slurry particle size, the reduction of the carrier scattering can be attained. Since the final firing temperature can be reduced; the fusion between the particles can be prevented; and the ferrite core material having uniform surface properties can be obtained, the resin coat can be made uniform.

In order to provide the slurry particle sizes as described above, it can be achieved by grinding the material using the above-described grinding machine such as the ball mill and the vibration mill for an adequate time. When media are used in such a grinding step, various media or beads can be used. A grinding machine is selected depending on the hardness, particle size, and target particle size after grinding of the material to be ground, and are suitably selected. The above-described slurry particle sizes can be also achieved by grinding the material with a wet ball mill or the like and grinding it again with a pulverizer having a high-speed shearing force.

Although such a pulverizer is not specifically limited, for example, a high-speed rotary grinding machine, an agitating-tank-type media agitating grinding machine, a distribution-pipe-type media agitating grinding machine, or the like are included. The media used in the media agitating grinding machine may be the above-described various media or beads. Although they are different depending on grinding machines, the hardness, particle size, and target particle size after grinding of the material to be ground, the use of beads having a small particle size is preferable, and the use of beads having a particle size of 0.3 to 1 mm is more preferable.

The difference between the final firing temperature and the preliminary firing temperature is desirably 280° C. or less in the method for producing according to the present invention, and more desirably 250° C. or less. When the above temperature difference exceeds 280° C., the carrier core having the above-described quality and characteristics is difficult to obtain.

The sinter obtained in such a manner is crushed and classified. The classifying method involves adjusting the particle size to a desired particle size by using the conventional wind-power classification, mesh filtration, precipitation or the like to obtain a carrier core.

Thereafter, the classified particles may optionally undergo oxide coating by heating their surfaces at a low temperature to adjust electric resistance. The oxide coating requires a common type of electric furnace such as a rotary electric furnace and a batch-type electric furnace, and the heat treatment is conducted at a temperature of 300 to 700° C., for example. The thickness of the oxide coating formed by this treatment is preferably 0.1 to 5 μm. If the thickness is less than 0.1 μm, the effect of the oxide coating layer is low. If that exceeds 5 μm, since the magnetization decreases, and the resistance becomes too high, disadvantages such as the decrease in developing capacity are apt to take place. The reduction may be optionally conducted prior to oxide coating.

Next, a resin is covered on the surface of the obtained carrier core. As a method for coating the resin, the resin is usually diluted in a solvent, and the resultant solution is coated on the surface of the above carrier core. The coating amount and the kind of the resin are as described above. Examples of solvents used here include toluene, xylene, butyl cellosolve acetate, methylethylketone, methylisobutylketone and methanol when the resin is soluble in an organic solvent. Water may be used when the resin is a water-soluble resin or an emulsion resin. As methods for coating the above-described carrier core with the above-described coating resin, methods known to the art, for example, brushing, a dry method, spray drying using a fluidizing bed, rotary drying, liquid immersion and drying using a universal agitator or the like can be used. In order to improve the coating rate, the method using a fluidizing bed is preferable.

When baking is performed after coating the carrier core with a resin, either an externally heating system or an internally heating system can be used, and for example, a stationary or fluidizing electric furnace, a rotary electric furnace, a burner furnace can be used, or microwave baking can be also used. Although the baking temperature differs depending on the resin to be used, the temperature of the melting point or the glass transition temperature or above is required, and in thermosetting resins or condensation cross-linking resins, the temperature must be raised until the resin cures completely.

Thus, after the resin is coated and baked on the surface of the carrier core, the carrier is cooled and ground, and the particle size is adjusted to obtain the resin-coated ferrite carrier according to the present invention.

<Electrophotographic Developer According to Present Invention>

The electrophotographic resin-coated carrier according to the present invention obtained as described above is mixed with a toner, and the resin-coated carrier electrophotographic with the toner is used as a two-component developer.

The toner used for the present invention can be produced by known methods such as a suspension polymerization method, an emulsion polymerization and a grinding method. As an example of the preparing method, the toner having a desired particle size can be obtained by sufficiently mixing a binding resin, a colorant and a charge control agent or the like using a mixer such as a Henschel mixer, then melting and kneading using a twin-screw extruder or the like to uniformly disperse the mixture, cooling, finely grinding using a jet mill or the like, and classifying the mixture using a wind-power classification machine or the like. Wax, magnetic powder, viscosity adjusters and the other additive agents may be optionally included. External additives or the like can be also added after classifying.

Although the binding resin used for the above-described toner is not particularly limited, polystyrene, chloropolystyrene, styrene-chlorostyrene copolymers, styrene-acrylic ester copolymers, styrene-methacrylic acid copolymers, further, rosin-modified maleic acid resins, epoxy resins, polyester resins, polyethylene resins, polypropylene resins, polyurethane resins and silicone resins or the like can be optionally used alone or in combination.

Examples of the charge control agents usable for the above-described toner include a nigrosin dye, a quaternary ammonium salt, an organic metal complex, a chelate complex and a metal-containing monoazo dye.

As coloring agents used for the above-described toner, conventionally-known dyes and/or pigments can be used. For example, carbon black, phthalocyanine blue, permanent red, chrome yellow, phthalocyanine green or the like can be used.

In addition, as the external additive, silica, titanium oxide, barium titanate, fine fluorine resin particles, fine acrylic resin particles or the like can be used alone, or in combination.

The present invention will be specifically described below on the basis of examples or the like.

Example 1

MnO, MgO and $Fe_2O_3$ were weighed so as to have the composition of MnO: 49.9 mol %, MgO: 0.1 mol % and $Fe_2O_3$: 50.0 mol %. Furthermore, 1.5 parts by weight of $ZrO_2$ and 0.5 parts by weight of $Bi_2O$ were respectively weighed and added to 100 parts by weight of these metal oxides. After this mixture was mixed and ground in a wet ball mill for 5 hours, preliminary firing was performed while the mixture was held at 1000° C. for 1 hour using a rotary kiln.

The preliminarily fired material thus obtained was ground in the wet ball mill for 7 hours to produce slurry, and slurry particle sizes, $D_{50}$ and $D_{90}$, (volume average size) were set to 1.3 μm and 2.0 μm.

Adequate quantities of a dispersant and a binder were added to the slurry obtained as described above, then granulated using a spray dryer, dried, and held in an electric furnace of a temperature of 1200° C. and an oxygen concentration of 0.3 vol. % for 6 hours to perform final baking.

After the obtained sinter was crushed, classifying was performed to adjust particle size, and ferrite particles were obtained. The ferrite particles thus obtained were held in a rotary atmospheric furnace held at 500° C. for 1 hour, and oxide coating was applied on the surface of each of the ferrite particles.

The ferrite particles to which the oxide coating was applied as described above were separated by magnetic separation and mixed, and the carrier core was obtained.

The average particle size, BET specific surface area, apparent density, magnetization (magnetization of a main body and magnetization of debris), amount of debris, shape factor SF-1, particle size distribution CV value and resistance at 1000V of the carrier core thus obtained were measured by the above-described method. The results are shown in Table 1.

A silicone resin (trade name: SR-2411, solid content: 20% by weight, manufactured by Dow Corning Toray Silicone Co., Ltd.) was dissolved in toluene, and 1.0% by weight of the solution was coated on the carrier core using a fluidized bed and baked at 250° C. for 3 hours to obtain a resin-coated ferrite carrier coated with the above resin.

A developer was prepared using the resin-coated ferrite carrier obtained as described above and a toner. As the toner, a polymerized toner manufactured by Ricoh Co., Ltd. was used, and the toner concentration was set to 6.0% by weight. A durability test was performed using the developer, and charge quantities and resistance over time were measured as the substitution evaluation of a continuous printing test in an actual machine test. Referring to the durability test of the developer, the developer was compulsively stirred for 0.5 minutes, 5 minutes, 60 minutes and 12 hours using a TUBULAR MIXER (type: Type T2F (manufactured by Willy A. Bachofen AG Maschinenfabrik)), and the charge quantities were measured using a suction type electrification amount measuring device (type: TB-220 (manufactured by Toshiba Chemical CORP.)). Referring to the resistance, the toner was sucked and separated from the developer, an initial value and a value after 12 hours at 1000V of the carrier dried by washing using toluene were evaluated as in the above description. These results are shown in Table 2.

Example 2

As shown in Table 1, a carrier core was obtained in the same manner as in Example 1 except that the preliminary baking temperature, the $D_{50}$ of the slurry particle size (volume average size), the $D_{90}$ thereof, the final baking temperature and the oxygen concentration were respectively set to 1100° C., 1.5 μm, 2.5 μm, 1180° C. and 1.0 vol. %. The average particle size, BET specific surface area, apparent density, magnetization (magnetization of a main body and magnetization of debris), amount of debris, shape factor SF-1, particle size distribution CV value and resistance at 1000V of the carrier core were evaluated in the same manner as in Example 1. The results are shown in Table 1.

Furthermore, an electrophotographic ferrite carrier and a developer were prepared in the same manner as in Example 1 using this carrier core. The charge quantities and resistance over time of the developer were evaluated in the same manner as in Example 1. The results are shown in Table 2.

Example 3

As shown in Table 1, a carrier core was obtained in the same manner as in Example 1 except that the preliminary baking temperature, the $D_{50}$ of the slurry particle size (volume average size), the $D_{90}$ thereof, the final baking temperature and the oxygen concentration were respectively set to 900° C., 1.8 μm, 2.7 μm, 1100° C. and 2.0 vol. %. The average particle size, BET specific surface area, apparent density, magnetization (magnetization of a main body and magnetization of debris), amount of debris, shape factor SF-1, particle size distribution CV value and resistance at 1000V of the carrier core were evaluated in the same manner as in Example 1. The results are shown in Table 1.

Furthermore, an electrophotographic ferrite carrier and a developer were prepared in the same manner as in Example 1 using this carrier core. The charge quantities and resistance over time of the developer were evaluated in the same manner as in Example 1. The results are shown in Table 2.

Comparative Example 1

As shown in Table 1, a carrier core was obtained in the same manner as in Example 1 except that the preliminary baking temperature, the $D_{50}$ of the slurry particle size (volume average size), the $D_{90}$ thereof, the final baking temperature and the oxygen concentration were respectively set to 950° C., 2.5 μm, 3.3 μm, 1250° C. and 1.5 vol. %. The average particle size, BET specific surface area, apparent density, magnetization (magnetization of a main body and magnetization of debris), amount of debris, shape factor SF-1, particle size distribution CV value and resistance at 1000V of the carrier core were evaluated in the same manner as in Example 1. The results are shown in Table 1.

Furthermore, an electrophotographic ferrite carrier and a developer were prepared in the same manner as in Example 1 using this carrier core. The charge quantities and resistance over time of the developer were evaluated in the same manner as in Example 1. The results are shown in Table 2.

Comparative Example 2

As shown in Table 1, a carrier core was obtained in the same manner as in Example 1 except that the preliminary baking temperature, the $D_{50}$ of the slurry particle size (volume average size), the $D_{90}$ thereof, the final baking temperature and the oxygen concentration were respectively set to 850° C., 3.4 μm, 5.2 μm, 1300° C. and 0.1 vol. %. The average particle size, BET specific surface area, apparent density, magnetization (magnetization of a main body and magnetization of debris), amount of debris, shape factor SF-1, particle size distribution CV value and resistance at 1000V of the carrier core were evaluated in the same manner as in Example 1. The results are shown in Table 1.

Furthermore, an electrophotographic ferrite carrier and a developer were prepared in the same manner as in Example 1 using this carrier core. The charge quantities and resistance over time of the developer were evaluated in the same manner as in Example 1. The results are shown in Table 2.

TABLE 1

| Production conditions and characteristics of carrier core | Unit | Ex. 1 | Ex. 2 | Ex. 3 | Com. Ex. 1 | Com. Ex. 2 |
|---|---|---|---|---|---|---|
| Preliminary firing temperature | ° C. | 1000 | 1100 | 900 | 950 | 850 |
| Final baking temperature | ° C. | 1200 | 1180 | 1100 | 1250 | 1300 |
| Slurry particle size $D_{90}$ | μm | 2.0 | 2.5 | 2.7 | 3.3 | 5.2 |

TABLE 1-continued

| Production conditions and characteristics of carrier core | Unit | Ex. 1 | Ex. 2 | Ex. 3 | Com. Ex. 1 | Com. Ex. 2 |
|---|---|---|---|---|---|---|
| Slurry particle size $D_{50}$ | μm | 1.3 | 1.5 | 1.8 | 2.5 | 3.4 |
| 1) Average particle size (median) | μm | 35.34 | 22.30 | 44.90 | 45.50 | 35.20 |
| 2) BET specific surface area | $M^2/g$ | 0.0594 | 0.0932 | 0.0600 | 0.0924 | 0.1138 |
| 3) Apparent density | $G/cm^3$ | 2.48 | 2.33 | 2.50 | 2.27 | 2.22 |
| 1) × 2) × 3) | | 5.21 | 4.84 | 6.74 | 9.54 | 8.89 |
| Percent inclusion of low magnetized material | ppm | 20 | 11 | 18 | 56 | 77 |
| Bulk magnetization A | $Am^2/kg$ | 67 | 61 | 53 | 56 | 71 |
| Debris magnetization B | $Am^2/kg$ | 65 | 59 | 48 | 45 | 59 |
| A − B | | 3 | 2 | 5 | 11 | 12 |
| Shape factor SF-1 | — | 106 | 104 | 112 | 125 | 135 |
| Particle size distribution CV value | — | 23 | 20 | 21 | 24 | 24 |
| Resistance (1000 V) | Ω | $8.0 \times 10^6$ | $5.5 \times 10^5$ | $7.0 \times 10^8$ | $1.0 \times 10^7$ | $3.0 \times 10^6$ |
| Overall evaluation | | ◎ | ◎ | ○ | Δ | X |

TABLE 2

| Examples/ Comparative Examples | Charge quantities (μC/g) 0.5 min | 5 min | 60 min | 12 hr | Difference of charge quantities (μC/g) Maximum value −12 hr | Maximum value −0.5 min | Resistance (Ω) (1000 V) 0 hr | 12 hr |
|---|---|---|---|---|---|---|---|---|
| Ex. 1 | 38.0 | 39.5 | 37.9 | 36.6 | 2.9 | 1.5 | $4.0 \times 10^7$ | $1.0 \times 10^7$ |
| Ex. 2 | 44.0 | 45.2 | 44.5 | 43.9 | 1.3 | 1.2 | $7.5 \times 10^6$ | $3.0 \times 10^6$ |
| Ex. 3 | 37.6 | 39.0 | 36.7 | 35.8 | 3.2 | 1.4 | $5.0 \times 10^9$ | $4.0 \times 10^9$ |
| Com. Ex. 1 | 32.5 | 40.7 | 39.4 | 33.2 | 7.5 | 8.2 | $4.2 \times 10^8$ | $5.0 \times 10^7$ |
| Com. Ex. 2 | 29.0 | 38.7 | 35.5 | 29.3 | 9.3 | 9.7 | $6.0 \times 10^7$ | $5.0 \times 10^6$ |

As clarified from the results in Table 1, the carrier cores used in Examples 1 to 3 provide low carrier scattering, and have good spherical degree and a sharp particle size distribution. Also, as shown in the results of Table 2, the carrier cores provide low variation with time of charge quantities and resistance in continuous printing when being used for the developer.

On the other hand, the carrier cores used in Comparative Examples 1 to 2 provide higher carrier scattering, and have more inferior spherical degree and a broader particle size distribution than those of Examples 1 to 3. As a result, the carrier cores provide high variation with time of charge quantities and resistance in continuous printing when being used for the developer.

The electrophotographic resin-coated ferrite carrier according to the present invention has a small particle size, a spherical shape and a sharp particle size distribution, and yet provides low beads carry over. The electrophotographic developer using the electrophotographic resin-coated ferrite carrier according to the present invention provides low deterioration with time of the charge quantities and resistance in continuous printing.

According to the producing method according to the present invention, the above-described ferrite carrier for the electrophotographic developer can be economically produced at industrial-scale productivity.

Therefore, the present invention can be suitably used for the two-component developer used in the electrophotography.

What is claimed is:

1. An electrophotographic resin-coated ferrite carrier having a carrier core coated with a resin, wherein a product of an apparent density ρ ($g/cm^3$), average particle size d (μm) and BET specific surface area S ($m^2/g$) of the carrier core satisfies the following condition $$4.5 \leqq \rho \times d \times S \leqq 8.5 \ (20 \leqq d \leqq 45),$$

and wherein the ferrite carrier is produced according to a method comprising grinding, mixing and pelletizing ferrite raw materials;

preliminarily baking the pellets at 900 to 1200° C.;

grinding the preliminarily fired pellets;

producing a slurry from the resulting particles;

granulating the obtained slurry;

baking the granules at 1100 to 1450° C. for 1 to 24 hours under an oxygen concentration of 0 to 21 vol. % to obtain a carrier core having an average particle size of 20 to 45 μm; and coating the obtained carrier core with a resin, wherein slurry particle sizes, $D_{50}$ and $D_{90}$ of the slur are 3.0 μm or less and 4.0 μm or less, respectively.

2. The electrophotographic resin-coated ferrite carrier according to claim 1, wherein at 1 KOe, a bulk magnetization A of the carrier core is 50 to 70 $Am^2/kg$; a difference (A−B) between the bulk magnetization A and a debris magnetization B thereof is 10 $Am^2/kg$ or less; and a percent inclusion of a carrier core having a magnetization at least 10 $Am^2/kg$ lower than the bulk magnetization A is 50 ppm or less.

3. The electrophotographic resin-coated ferrite carrier according to claim 1, wherein the carrier core has a shape factor SF-1 of 100 to 120.

4. The electrophotographic resin-coated ferrite carrier according to claim 1, wherein the carrier core has a particle size distribution CV value of 23 or less.

5. The electrophotographic resin-coated ferrite carrier according to claim 1, wherein the carrier core has a resistance of $10^5$ to $10^9$Ω at 1000 V.

6. The electrophotographic resin-coated ferrite carrier according to claim 1, wherein the carrier core is coated with 0.1 to 10% by weight of the resin.

7. An electrophotographic developer comprising the resin-coated ferrite carrier according to claim 1 and a toner.

8. An electrophotographic resin-coated ferrite carrier having a carrier core coated with a resin, wherein a product of an apparent density ρ ($g/cm^3$), average particle size d (μm) and BET specific surface area S ($m^2/g$) of the carrier core satisfies the following condition $$4.5 \leqq \rho \times d \times S \leqq 8.5 \ (20 \leqq d \leqq 45), \text{ and}$$

wherein slurry particle sizes, $D_{50}$ and $D_{90}$, of a slurry are 3.0 μm or less and 4.0 μm or less, respectively.

* * * * *